United States Patent [19]

Hoshino et al.

[11] Patent Number: 4,648,304

[45] Date of Patent: Mar. 10, 1987

[54] TREMOLO DEVICE FOR A GUITAR

[75] Inventors: Yoshiki Hoshino; Kazuhiro Matsui, both of Aichi, Japan

[73] Assignee: Hoshino Gakki Co., Ltd., Japan

[21] Appl. No.: 775,750

[22] Filed: Sep. 13, 1985

[30] Foreign Application Priority Data

Jan. 18, 1985 [JP] Japan ..... 60-8049

[51] Int. Cl.[4] ..... G10D 3/00

[52] U.S. Cl. ..... 84/313; 84/297 S; 84/312 R

[58] Field of Search ..... 84/297 R, 297 S, 298, 84/299, 312 R, 313

[56] References Cited

U.S. PATENT DOCUMENTS

| | | | |
|---|---|---|---|
| 2,741,146 | 4/1956 | Fender | 84/313 |
| 3,124,991 | 3/1964 | Costen | 84/313 |
| 4,549,460 | 10/1985 | Gressett, Jr. et al. | 84/298 |

*Primary Examiner*—Benjamin R. Fuller

*Attorney, Agent, or Firm*—Ostrolenk, Faber, Gerb & Soffen

[57] ABSTRACT

A tremolo device for a stringed instrument such as a guitar in which a reelable member is provided to which the ends of the instrument strings are connected. Said reelable device includes a tremolo arm for oscillating the reelable device in one direction and return springs for restoring the reelable device in the opposite direction to provide a tremolo effect under the control of the operator. The reelable device comprises a plurality of arcuate members, each individual to one of the strings with the radius of curvature of each arcuate member being smaller for the largest diameter spring and larger for the smallest diameter string and varying appropriately in between. Other effects may also be produced in that the arcuate curvature may be other than a simple arc.

14 Claims, 6 Drawing Figures

14
30
35
19
32
$S_6$
$S_5$
$S_4$
$S_3$
$S_2$
$S_1$
20
25
B
26
13
3
31

TREMOLO DEVICE FOR A GUITAR

BACKGROUND OF THE INVENTION

The present invention relates to a tremolo device for a stringed instrument, more particularly a guitar, for individual respective adjustments of string tension upon operation of the tremolo.

A tremolo device can rapidly change the pitch of all of the strings. In an ordinary tremolo device for a guitar, a tremolo plate which holds the strings is pivoted or tilted back and forth by means of an attached tremolo arm, creating changes in the sound by providing modifications in tension of the various strings. With such a conventional tremolo device, however, the same tension variations have been given to the strings regardless of the diameters of the strings. Experimental data are included in this specification which provide a fuller explanation, but it is obvious that the extent of the change in the string sounds become different due to the differences in the diameters of the strings. There is no way of foretelling nor is it possible to expect the harmony or tuned agreement of various sounds in a chord to be the same when the tremolo device is operated. The trained ear may detect a detuning or mistuning of the strings in a chord during the operation of the tremolo device.

SUMMARY OF THE INVENTION

The primary object of the present invention is providing a tremolo device which controls pitch variations for different diameter strings.

Another object of the invention is to control the tension changes on the various diameter strings at the time of tremolo operation.

A further object of the present invention is providing a novel tremolo device which makes the tremolo playing harmonic.

A further object of the present invention is the provision of a tremolo device at the bridge for retaining the ends of the strings at the bridge.

The present invention is directed to individual string holding elements of the tremolo device which are placed together so that they form a composite reel but in which the string holding elements individual to each string are concentrically arrayed and constructed of arc-shaped parts with different radii. A composite unit becomes a "reeling" member which is rotatable back and forth by a tremolo arm and by a spring return. As with all tremolo devices, operation of this tremolo device changes string tension, but not string length. The arc-shaped parts are set up in such a manner that the change in tension of the string at the time of reeling may be carried out approximately synchronously with the harmony of each chord. Harmonic tuning is done by varying string length owing to movement at one end of the string, such as at the bridge. Pitch tuning of each string is controlled by adjusting its tension.

The invention thus further relates to a tremolo device whereby the change in the tension of each string forming a chord is controlled at the time of the tremolo playing, thereby making it possible to carry out harmonic tremolo playing.

Essentially, the selected radius of each arc-shaped element of the reelable member is a function of the diameter of its string. Where the string is of large diameter and therefore suitable for playing at a low pitch, the arc-shaped member provides a relatively smaller radius arc. The diameter of the arc also controls its circumferential length. For any angle of rotation, a greater diameter arc causes a greater length motion of the associated string in tensioning. Where the string is of a small diameter and therefore adapted to be played at a higher pitch, the arc-shaped member provides a relatively greater radius arc. The arc-shaped members also provide means of attachment of the strings so that when looking down axially at the length of the composite reelable member, the different strings will be seen to enter the reelable member.

The foregoing and other objects and features of the present invention will become apparent from the following description and the accompanying drawings.

DESCRIPTION OF THE PREFERRED EMBODIMENTS

Figure 1:
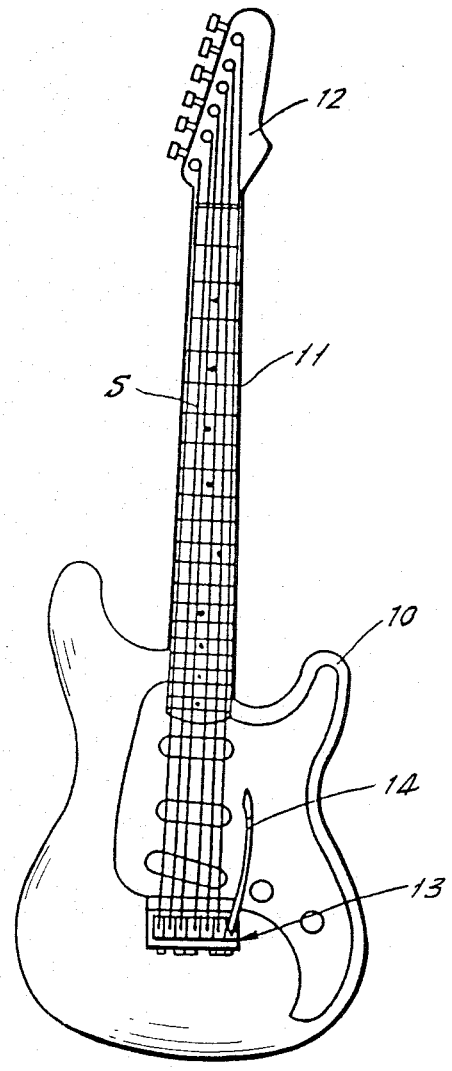
FIG. 1 is a front view of a guitar providing the novel tremolo member.
Figure 3:
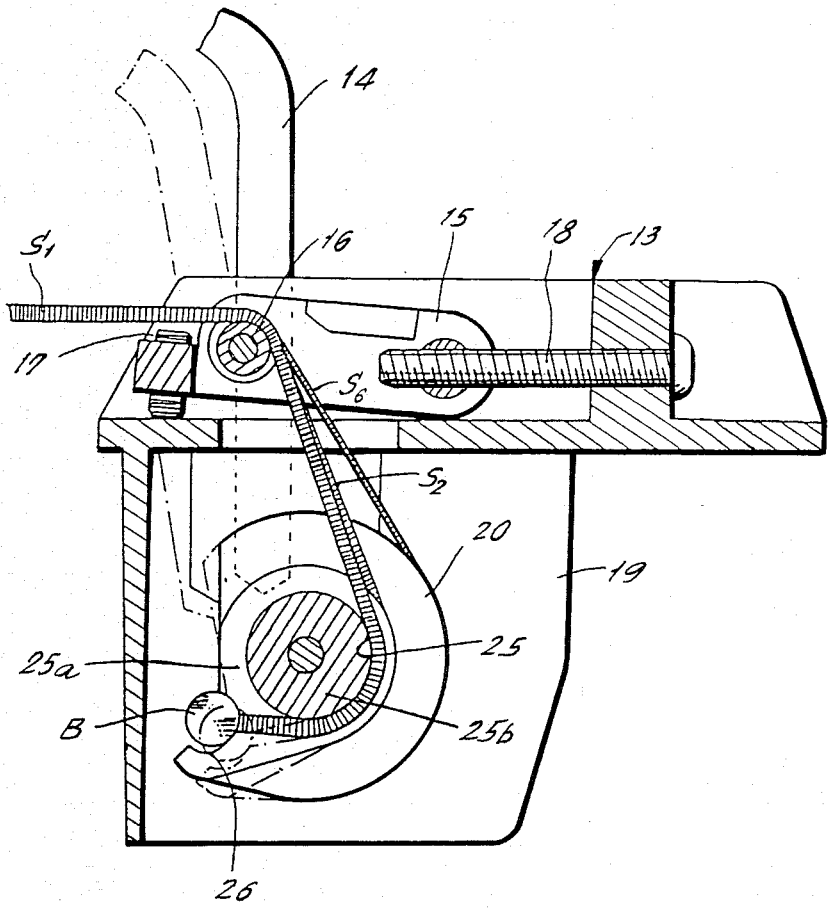
FIG. 3 is a cross-sectional view taken along line 3—3 of FIG. 2.

Referring to FIGS. 1 and 3, a bridge saddle 15 having a string support part 16 is provided on the bridge tail piece 13 in such a manner that it is freely adjustable. An adjusting screw 17 is for adjusting the height of the saddle 15 and another adjusting screw 18 is for setting the longitudinal position of the saddle for harmonic tuning of the strings. A string S1, which is a large diameter string for playing a relatively low pitch note, is supported over the string support 16 and in the groove 25*a* of the arcuate string holding member 25 having the hub 25*b* over which the string is guided so that the ball end of the string is held by the string support notch 26.

Figure 2:
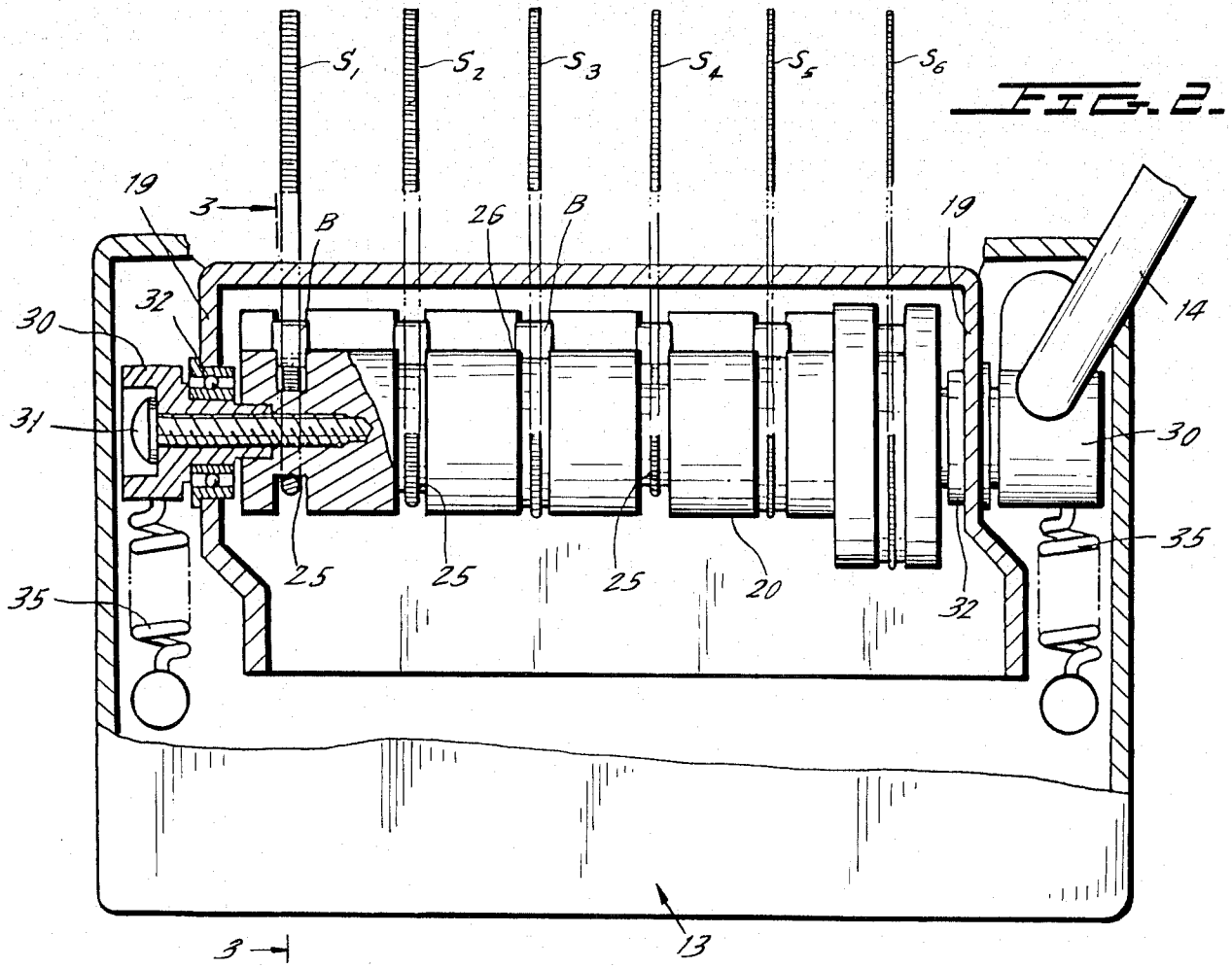
FIG. 2 is a view partly in section, with the upper part of the bridge tail piece having been removed, of a guitar bridge carrying the tremolo device.

FIG. 3 also shows the support for strings S2 and S6 as may be seen from FIGS. 2 and 3. The reeling member 20 is journaled on and between both of the lower side plates 19 of the bridge tail piece 13 and the member is installed such that it is freely reelable, that is rotatable in either direction. The composite reeling member is comprised of various arcuate pieces 25 which are held together on the reeling member. Stopping blocks 30 at each end stop or control the main reeling member and maintain the reeling members as a whole as a single unitary structure.

A respective stopper screw 31 is provided for interengaging the members 30 on each side of the reeling member 20. The return spring 35 attached to a member 30 returns the reeling member 20 to its original angular position after it has been rotated by the tremolo arm 14 which is also attached to a member 30. While the reeling member 20 appears to be a unitary construction, preferably it is made up of a number of string holding parts 25, each in the shape of an arc so as to make it possible for the tension of each string to be changed, without steps, by the reeling of the reeling member 20. In addition, the arc-shaped string holding parts 25 are formed with different radii and are arranged along the same center.

It is preferable to form the reeling member from a plurality of string holding parts 25 which may then be locked together in any suitable manner. It is therefore relatively easy to construct the reeling device by utilizing separate members 25 locked together rather than seeking to carve or mold the complex shape of the reeling member. Secondly, the string holding parts can, if necessary, be modified or changed by separating the reeling members and substituting other string holding parts.

Figure 4:
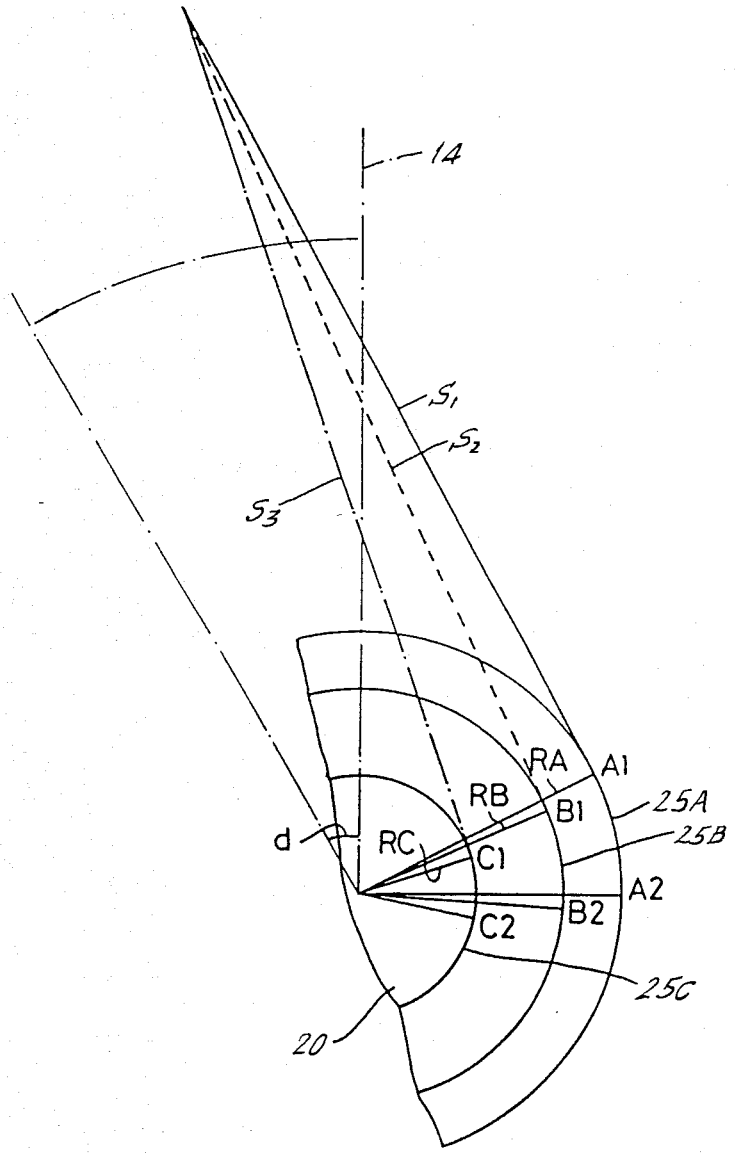
FIG. 4 is a graphic representation of the string holding part of the tremolo device.

FIG. 4 is a schematic view corresponding essentially to FIG. 3 but showing how the reeling device 20 may be arranged so that the string holding parts are on the same extended center having arc-shaped pieces of different radii. In FIG. 4, it will be seen that the strings S1, S2 and S3 are held by the string holding parts 25*a*, 25*b* and 25*c* having arcs of radii Ra, Rb and Rc, respectively. The amount of phase change (that is the loosening distance) of each string at the time when the reeling member 20 has been reeled or rotated by a specific angle D by the tremolo arm 14 (to the front) can be easily calculated as arc A1-A2, arc B1-B2 and arc C1-C2, respectively. A string fastened at and moving around a larger diameter arc is moved a greater distance during tensioning than a string moving around a smaller diameter arc. It can be readily understood that the situation is the same if there are six strings, or if the string holding parts may not be arranged coconcentrically, and in the case of a composite arc instead of a simple arc.

The tensioning of any particular string as the result of the operation of the tremolo arm may be made of a variable type by appropriate curvature of the arcuate portion over which the string passes. Where this arcuate portion is other than truly circular, the variation would not be a function of equal angle variation but would be a function of the angular position of the composite arcuate member during its rotation. It is thus possible to build in some added tremolo effects with appropriate curvature of the arcuate member 25 over which the string passes. Primarily, however, the structure would be, in most cases, directed to the constant areas of the type illustrated in FIGS. 3 and 4.

The amount of the phase change is determined by the amount of the change in pitch. In addition, the interrelationship between the change in the tension of the string or the amount of the tension of the string or the amount of the loosening of the string and the change in the pitch can be stated numerically as a change in the number of vibrations (HZ) of the string.

A detailed explanation is herewith given for the instance where the various string holding parts have been arranged in such a manner that the change in the tension or pitch of each string will be approximately synchronous with the harmony of the string. Such a tremolo device makes it possible to carry out a radically new and unexpected performance technique called harmonic tremolo playing which has never been thought possible in the past.

Figure 5:
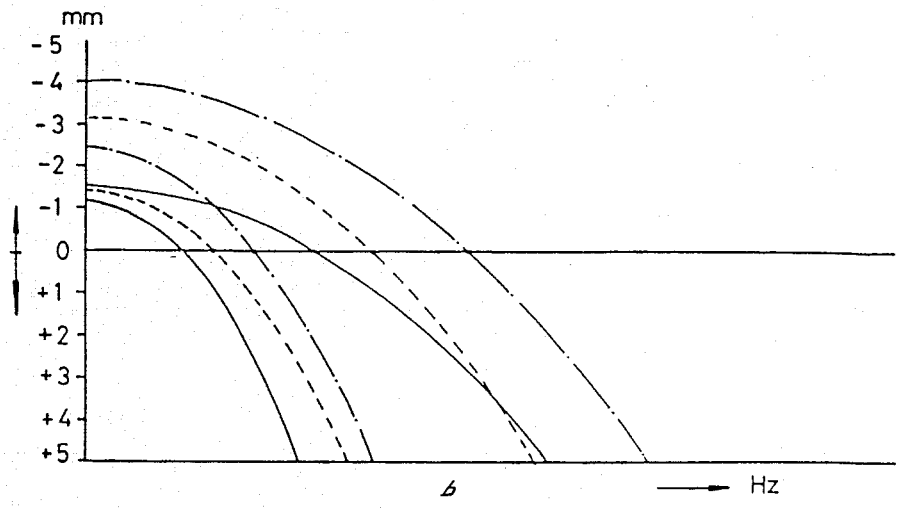
FIG. 5 PRIOR ART
FIG. 5 is a graphic representation of Table 1 (herein below) showing the relationship between changes in tension of each string and the change in sound (frequency-Hz of the string) with the prior art tremolo device.

Table 1 below shows the correlation between the changes in the tension in each string of the guitar (the amount of tightening or loosening) and the change in the sound or pitch of the string (number of vibrations equals HZ). The graph shown in FIG. 5 was prepared on the basis of Table 1. As can be seen in Table 1 and FIG. 5, if the same deviation (phase difference) is given for all strings during operation of a conventional tremolo device, the curve showing the changes in the pitches produced by various strings become varied with the result that an uncoordinated tremolo sound is produced. This is the kind of sound made using a conventional tremolo device.

Figure 6:
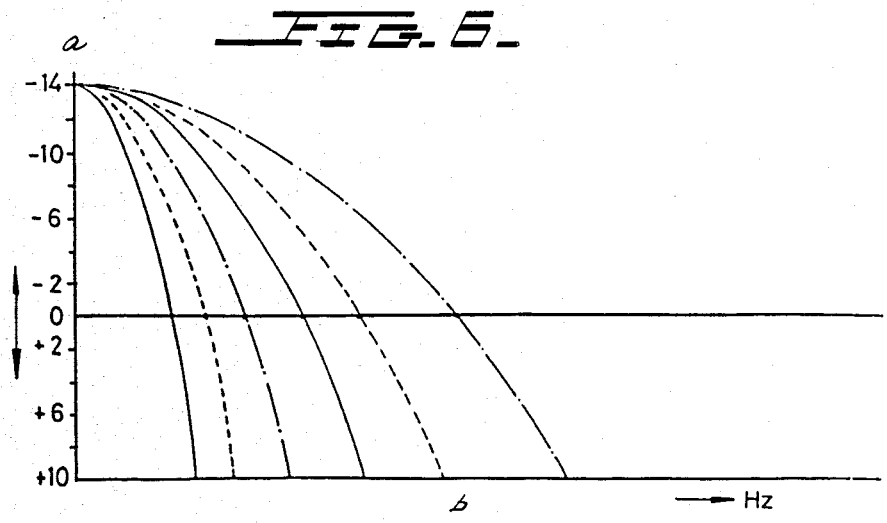
FIG. 6 is a graphic representation similar to that in FIG. 5 but showing the relative relationship between tension changes in the strings and changes in sounds according to the present invention.

On the other hand, Table 2 and FIG. 6 illustrate the tremolo device according to this invention in which the strings are held by arc-shaped parts of different radii in such a manner that the change in the tension and thus of pitch of each string may be carried out approximately synchronously with the harmony of each string. As shown in this example, the amount of the deviation (phase change) of the thickest chord is expressed by 1. If the deviation is carried out in the order of the thickness of the chords at the ratios of 1.25, 2.4, 1.2, 2.46, 4.01, it becomes possible to develop harmonic tremolo sound as shown in FIG. 6. Where the changes in pitch coordinate with the changes in the harmonic result, it is necessary to form the string holding parts of the reeling member roughly on the basis of these ratios.

TABLE 1

| a No. | No. 1 | No. 2 | No. 3 | No. 4 | No. 5 | No. 6 |
|---|---|---|---|---|---|---|
| b | 4 E | 3 B | 3 G | 3 D | 2 A | 2 E |
| c | 329.63 | 246.94 | 196.00 | 146.83 | 110.00 | 82.41 |
| d | 0.0229 | 0.0279 | 0.0406 | 0.0330 | 0.0432 | 0.0457 |
| e | (Hz) | (Hz) | (Hz) | (Hz) | (Hz) | (Hz) |
| −5.0 (cm) | 0.00 | 0.00 | 0.00 | 0.00 | 0.00 | 0.00 |
| −4.0 | 23.93 | 0.00 | 0.00 | 0.00 | 0.00 | 0.00 |
| −3.0 | 166.87 | 56.51 | 0.00 | 0.00 | 0.00 | 0.00 |
| −2.0 | 234.41 | 150.25 | 0.00 | 64.97 | 0.00 | 0.00 |
| −1.0 | 286.16 | 204.54 | 115.73 | 113.65 | 61.92 | 28.36 |
| 0 | 329.63 | 246.94 | 196.00 | 146.83 | 110.00 | 82.41 |
| +1.0 | 367.78 | 282.85 | 251.56 | 173.83 | 142.53 | 112.88 |
| +2.0 | 402.12 | 314.50 | 296.95 | 196.68 | 168.76 | 136.58 |
| +3.0 | 443.57 | 343.08 | 335.51 | 217.18 | 191.30 | 156.62 |
| +4.0 | 462.70 | 369.30 | 370.11 | 235.79 | 211.33 | 174.28 |
| +5.0 | 489.95 | 393.63 | 401.55 | 252.94 | 229.51 | 190.20 |

a = string number; b = diameter of string in cm; c = diameter of the string holding part in mm; d = ratio; e = reeling or movement of the reeling member; and f = angle

TABLE 2

| a No. | No. 1 | No. 2 | No. 3 | No. 4 | No. 5 | No. 6 |
|---|---|---|---|---|---|---|
| b | 0.0229 | 0.0279 | 0.0406 | 0.0330 | 0.0432 | 0.0457 |
| c | 36.09 | 22.10 | 10.80 | 21.60 | 11.25 | 9.00 |
| d | (4.01) | (2.46) | (1.20) | (2.40) | (1.25) | (1) |
| e | (Hz) | (Hz) | (Hz) | (Hz) | (Hz) | (Hz) |
| f −15° | 0.00 | 0.00 | 0.00 | 0.00 | 0.00 | 0.00 |
| −14° | 41.36 | 34.21 | 31.12 | 21.81 | 17.71 | 14.36 |
| −12° | 136.96 | 98.92 | 79.62 | 59.22 | 44.76 | 33.91 |
| −10° | 180.37 | 135.56 | 108.18 | 80.92 | 60.76 | 45.74 |
| −8° | 218.78 | 164.14 | 130.61 | 97.72 | 73.33 | 55.08 |
| −6° | 251.28 | 188.38 | 149.70 | 112.08 | 84.03 | 63.04 |
| −4° | 279.94 | 209.78 | 166.59 | 124.77 | 93.50 | 70.10 |
| −2° | 305.84 | 229.14 | 181.90 | 136.26 | 102.90 | 76.50 |
| 0° | 329.63 | 246.94 | 196.00 | 146.83 | 110.00 | 82.41 |
| +2° | 351.74 | 263.50 | 209.14 | 156.67 | 117.37 | 87.91 |
| +4° | 372.47 | 279.03 | 221.48 | 156.91 | 124.29 | 93.08 |
| +6° | 392.04 | 293.71 | 233.15 | 174.64 | 130.84 | 97.98 |
| +8° | 410.61 | 307.64 | 244.25 | 182.94 | 143.02 | 107.08 |
| +10° | 428.32 | 320.94 | 254.86 | 190.86 | 143.02 | 107.08 |

a = string number; b = diameter of string in cm; c = diameter of the string holding part in mm; d = ratio; e = reeling or movement of the reeling member; and f = angle In accordance with the present invention, since the strings are held by the arc-shaped parts, the change in the tension of the string is carried out smoothly without any stepping motion. As has been shown in the example above, the securement of the strings can be effected simply and firmly. Further, it becomes possible to use strings having the ball ends as they are known without any special treatment of the strings. In this manner, substantial advantages accrue in simplifying the string holding structure.

In the foregoing, the present invention has been described in connection with an illustrative embodiment thereof. Since many variations and modifications of the present invention will now become obvious to those skilled in the art, it is preferred that the scope of this invention be determined not by the specific disclosure herein contained, but only by the appended claims.

What is claimed is:

1. A tremolo device for a stringed instrument having a plurality of strings, the strings each having a diameter different from the others and the tremolo device including a bridge structure mounted on the instrument and comprising a rotatable reelable member extending transversely of the strings; an arm connected to the reelable member for rotating the reelable member for producing a tremolo effect;

means for mounting the strings on the reelable member comprising a curved member on the reelable member individual to each string and each curved member being separate and replaceable and containing an anchor for its string and the strings each passing over the respective arcuate member individual to that string, said arcuate members each having different sized curvatures with their circumferences varying in length in a relative proportion to the diameter of the respective string whereby rotating the reelable member back and forth around its axis rotates all of the curved members and thereby causes a variation in tension of each string related to the relative diameter of each string.

2. The tremolo device of claim 1, wherein all of the curved members extend along a common center constituting the center of rotation of the reelable device.

3. The tremolo device of claim 1, wherein the curved members are all curved as respectively circular arcs around which the respective string wraps and unwraps, respectively, as the reelable device is rotated.

4. The tremolo device of claim 1, wherein the curved member for any one string may have its surface different in curvature from others of the curved paths to provide a predetermined range of variation in harmonic sound as well as pitch.

5. The tremolo device of claim 1, wherein the bridge structure carrying the reelable device provides also a path for guiding each string to its respective arcuate member.

6. The tremolo device of claim 1, wherein the bridge structure provides means for initially fine tuning the string with respect to tension and harmonic sound.

7. The tremolo device of claim 2, wherein the curvature of at least one of the curved members for at least one of said strings has varying radii along the curved member to provide a variable tensioning of the string in a single tremolo arm.

8. The tremolo device of claim 3, wherein the arcuate curvature for the string of the largest diameter is at the smallest radius.

9. The tremolo device of claim 8, wherein the arcuate curvature for the string of the smallest diameter is at the largest radius.

10. The tremolo device of claim 3, wherein the arcuate curvature for the string of the smallest diameter is at the largest radius.

11. The tremolo device of claim 1, wherein the tremolo arm is adapted for rotating the reelable member in at least one direction and at least one spring connected to said reelable member to return said reelable member.

12. The tremolo device of claim 1, wherein the curved members for adjusting the springs are mounted beneath the bridge.

13. The tremolo device of claim 6, including means for adjusting string height.

14. The tremolo device of claim 6, including means for adjusting string length.

* * * * *